US006293210B1

(12) United States Patent
Freeman et al.

(10) Patent No.: US 6,293,210 B1
(45) Date of Patent: Sep. 25, 2001

(54) NEEDLE RECIPROCATION

(75) Inventors: James Edward Freeman, Lancashire; Raymond Palmer, Warwickshire, both of (GB)

(73) Assignee: Jimtex Developments Limited, Rochdale (GB)

( * ) Notice: Subject to any disclaimer, the term of this patent is extended or adjusted under 35 U.S.C. 154(b) by 0 days.

(21) Appl. No.: 09/066,277

(22) Filed: Apr. 24, 1998

Related U.S. Application Data

(63) Continuation of application No. PCT/GB96/02601, filed on Oct. 24, 1996.

(30) Foreign Application Priority Data

Oct. 24, 1995 (GB) ..... 9521768
Dec. 15, 1995 (GB) ..... 9525744

(51) Int. Cl.[7] ..... D05C 15/20
(52) U.S. Cl. ..... 112/80.01; 112/470.01; 28/107
(58) Field of Search ..... 112/80.23, 80.01, 112/80.24, 470.01, 275; 28/107, 108, 109, 110, 111, 112, 113, 114, 115

(56) References Cited

U.S. PATENT DOCUMENTS

| | | | | |
|---|---|---|---|---|
| 3,875,489 | | 4/1975 | Von Brimer | 318/691 |
| 4,891,870 | * | 1/1990 | Müller | 28/113 |
| 5,461,996 | * | 10/1995 | Kaju | 112/80.23 |
| 5,504,979 | * | 4/1996 | Sheehan et al. | 28/113 |
| 5,571,240 | * | 11/1996 | Yamauchi et al. | 112/275 |
| 5,636,420 | * | 6/1997 | Jourde et al. | 28/111 |
| 5,648,908 | * | 7/1997 | Chirn et al. | 112/80.23 |
| 5,664,305 | * | 9/1997 | Lawton et al. | 28/111 |
| 5,740,593 | * | 4/1998 | Sheehan et al. | 28/113 |
| 5,794,554 | * | 8/1998 | Akahane et al. | 112/470.01 |

FOREIGN PATENT DOCUMENTS

| | | |
|---|---|---|
| 9608594 | 3/1996 | (WO) . |
| 9621763 | 7/1996 | (WO) . |

* cited by examiner

*Primary Examiner*—Danny Worrell
(74) *Attorney, Agent, or Firm*—Baker Botts L.L.P.

(57) ABSTRACT

There is disclosed a material or fabric making or processing operation involving needle penetration of a fibre, fabric or material layer (12) in which the needle penetration action is controlled by control means (18) by which the needle penetration characteristics can be varied within the penetration action and as between penetration actions.

27 Claims, 6 Drawing Sheets

NEEDLE RECIPROCATION

This is a continuation of copending application Ser. No. PCT/GB96/02601 filed Oct. 24, 1996.

BACKGROUND OF THE INVENTION

This invention relates to the field of textile or material fabrication and processing; in particular to an apparatus and method for reciprocation of one or more needles for such fabrication and processing purposes, particularly for tufting, needling and sewing purposes.

Tufting, needling and sewing are well known processes which are characterized by the reciprocating use of at least one needle for the purpose of making or processing textiles or related materials. Tufting is a method of inserting, with needles, pile yarn into pre-made substrates. Carpets and bed coverings are examples of products commonly obtained by such processing. Needling is a process whereby batting—layers of non-woven fibers—are pierced with barbed needles to produce, for example, needled felts or needled floor covering fabrics. Machine sewing comprises a system of combined loop movements which involve reciprocation of a yarn transporting needle.

Prior art tufting, needling and sewing systems generally employ mechanical components such as cam discs, tension rollers, crank actuating systems, etc. These systems are of relatively low efficiency, requiring high energy input, and in use have large inertias. Furthermore, it is at best difficult to vary working parameters such as pattern and stitch length with these prior art systems—certainly on rapid timescales, e.g. on a stitch by stitch basis. U.S. Pat. No. 3,735,717 and U.S. Pat. No. 3,875,489 describe an electromagnetic drive system which may be applied to sewing machines to provide synchronized motion of needle and bobbin carrier. These documents represent an early possibly seminal—attempt to move away from traditional mechanical components.

SUMMARY OF THE INVENTION

The present invention addresses the aforementioned problems, and, further, provides textile fabrication and processing systems that can react rapidly and adaptively to changes in working conditions.

According to one aspect of the invention there is provided a material or fabric making or processing operation involving needle penetration of a fiber, fabric or material layer in which the needle penetration action is controlled by control means by which the needle penetration characteristics can be varied within the penetration action and as between penetration actions.

The needle penetration characteristics may comprise stitch or loop height, stroke, stroke frequency, pitch length or combinations thereof. It should be noted that the stitch or loop height may differ from the stroke—which is a measure of the mechanical movement of the needle—because of yarn tension and relaxation effects in surrounding stitches.

It will be understood that the needle penetration action includes the withdrawal of the needle from the material or fabric, and that this withdrawal is also controlled by the control means.

The needle penetration action may be controlled by a feedback arrangement wherein at least one variable is sensed and in response to said at least one variable the needle penetration characteristics and/or other apparatus characteristics are adjusted so as to optimized or counteract variations in a defined operational characteristic or characteristics.

Consequently, optimised dynamic elements such as control, power, production rate, patterning format and, system deviations are monitored and controlled, or used under total control as a teach mode facility.

The control means may comprise at least one electronically controlled servo actuator. Such actuators are employed in place of the high energy, low efficiency mechanical systems traditionally used, which systems may comprise cam discs, tension rollers, lay shafts, eccentrics and crank actuating systems. The electronically controlled actuators are low energy, high efficiency devices which can achieve higher operating speeds than traditional mechanical systems. The control means may further comprise a microprocessor or computer.

The variables sensed may include actuator position and actuator force profile.

Yarn tension may be sensed.

The actuator or actuators may comprise linear actuators.

The actuator or actuators may comprise rotary actuators.

At least one secondary operation may be controlled by the control means.

At least one secondary operation may be controlled by a master-slave system.

The operation may be tufting and the secondary operation may comprise looping, and may further comprise cutting.

The operation may be sewing and the secondary operation may comprise stitch locking.

The operation may be needling and the secondary operation may comprise translation of batting. The at least one secondary operation may further comprise upward motion of a base plate and a stripper plate by at least one actuator, said motion acting to increase the relative velocity of the plurality of needling needles with respect to the base plate and stripper plate.

The operation may be a needling operation for fabricating a three dimensional felted structure comprising the steps of:

mounting a three dimensional non-woven material substrate; and needling said substrate with at least one needle board having a plurality of needles; said needling being accompanied by relative movement or rotation of said substrate and said needles.

Two needling boards or sets of needling boards may be employed, said boards or sets of boards reciprocating along mutually orthogonal axes.

The three dimensional structure thus produced may be set by plasticizing, coating or heating.

The three dimensional substrate may be produced from a pre-needled, carded felt. The pre-needled, carded felt may be divided into sections and reassembled to produce the three dimensional substrate.

According to a second aspect of the invention there is provided apparatus for material or fabric making or processing comprising at least one fiber, fabric or material layer penetrating needle, and control means for controlling the needle penetration action such that the needle penetration characteristics can be varied within the penetration action and as between penetration actions. The control means may comprise at least one electronically controlled servo actuator.

The actuator or actuators may comprise linear actuators.

The actuator or actuators may comprise rotary actuators, and said rotary actuators may produce linear or arcuate reciprocation of the needle or needles through a rotary to linear converter or a rotary to arcuate converter.

The control means may filter comprise a microprocessor or computer.

The control means may comprise at least one sensing means for sensing a variable and the control means may adjust the needle penetration characteristics and/or other apparatus characteristics in response to said variable or variables so as to optimize or counteract variations in a defined operational characteristic or characteristics. The sensing means may comprise actuator position monitoring means, actuator force measurement means, yarn tension monitoring means, or combinations thereof. Other parameters, such as temperature and humidity, may be sensed.

BRIEF DESCRIPTION OF THE DRAWINGS

Embodiments of apparatus and methods for needle reciprocation according to the invention will now be described with reference to the accompanying drawings, in which:

FIGS. 1–11 depict embodiments of the present invention. The invention further comprises the associated material or fabric making or processing operation which involves needle penetration of a fiber, fabric or material layer in which the needle penetration action is controlled by control means by which the needle penetration characteristics can be varied within the penetration action and as between penetration actions. A further aspect of the invention is the operation of individual needles or a plurality of needles (located on a needle head or needle heads) with electronically controlled servo actuators.

The invention permits variation of needle penetration characteristics such as stitch or loop height (and hence stitch or loop length), stroke and, pitch length. For example, it is preferable with some materials to employ a rapid needle down stroke and a slower return stroke. Furthermore, the variation of needle penetration characteristics may be performed on stroke by stroke basis, or even during a stroke, enabling rapid and flexible system adaptation to variations in conditions in order to maintain optimal operating efficiency. Further still, variation of patterning parameters and formats such as stitch or loop height, spacing and density—on a stroke by stroke basis if required—is possible, permitting easy programming of desired patterns, designs and loop densities.

Actuators may be connected to the devised components by direct connection or by means such as a constrained ball, Bowden cable, linear or continuous toothed belts, a tensioned steel belt, cranks, levers or other similar mechanisms.

The invention is particularly directed towards tufting, needling and sewing applications; embodiments of these aspects of the invention are described below.

1. Tufting

Figure 1:
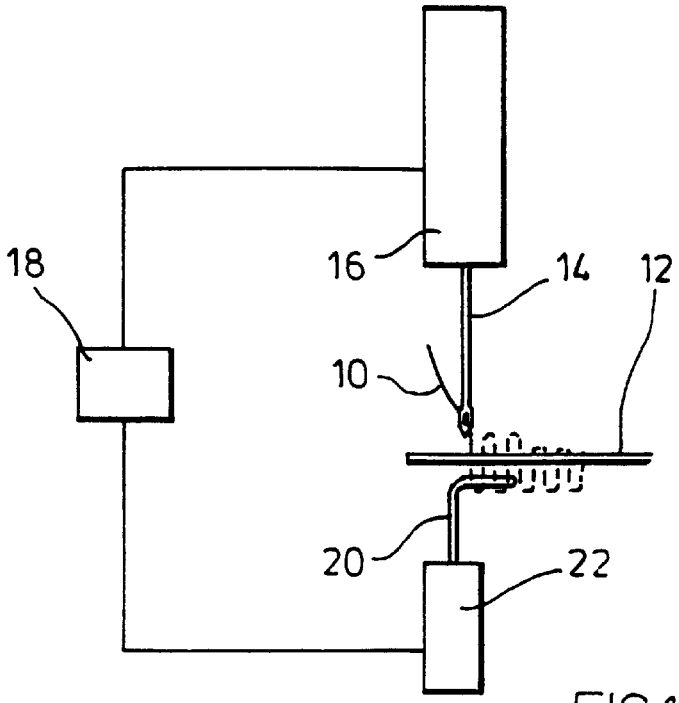
FIG. 1 shows a side view of tufting machine.

FIG. 1 shows a portion of a tufting machine for inserting pile yarn 10 into a material substrate 12, the machine having a loop forming needle 14, this needle being individually reciprocated into and out of the substrate 12 by a dedicated electronic actuator 16 under the control of a microprocessor 18. It is understood that the machine comprises further actuator driven needles (not shown) which operate under the control of the microprocessor 18. Standard translation means (not shown) are employed to translate the substrate 12 across the tuffing region, and the machine further comprises a looper 20, said looper being driven by a further electronic actuator 22. The use of a plurality of loopers is within the scope of the invention.

The looper 20 performs a rocking motion (not shown) under the action of the electronic actuator 22 so as to come into and out of engagement with newly formed yarn loops, thereby assisting in the formation of said loops. In the present embodiment the looper actuator 22 operates under the control of the microprocessor 18, although it should be noted that master-slave drive systems are applicable, as indeed are combinations of these two control systems. It should be noted that the translation of the substrate may also be performed under the control of the microprocessor 18, thereby synchronizing the speed of the substrate translation to the needle stroke rate. Such programmable operation may be continuous or intermittent.

Although in the present embodiment each needle is driven by an individual, dedicated actuator, it is quite possible—for instance in applications where parallel loop formation is required, such as for borders, stripes and similar pattern formats—to use single actuators or a plurality of actuators to drive needle heads having a plurality of needles.

"Plain patterning"—that is, patterns produced on a single color background—requires variation of pile height in order to vary the appearance of the fabric construction or texture. Traditionally, this is achieved by cam discs and/or tension rollers in the yarn line to vary loop length; in other words, pile height is varied relative to the background tuft height In the present embodiment, infinite variations in tuft height are achievable, irrespective of the background loop height or the previous or next loop height. It is noted that in some instances yarn loops are cut as they are formed (cut pile), and such an operation is within the compass of the present invention, whereby the engagement of the cutter is driven by direct actuation.

Figure 2:
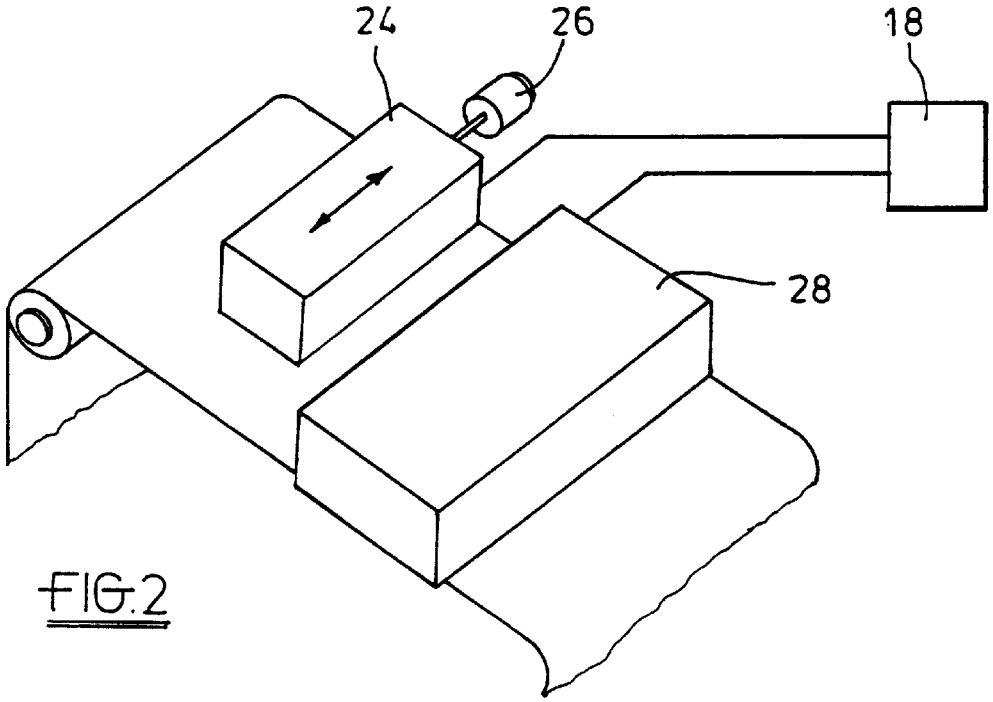
FIG. 2 shows a roving head arrangement.

"Color patterning", wherein small, regular patterns of concentrated color are introduced in combination with pile height variations, is a popular patterning method. FIG. 2 shows an embodiment of the present invention which permits microprocessor controlled color patterning wherein a roving head 24 is employed, the roving head 24 having as electronically actuated needle or needles, threaded with colored yarn and operating under the control of microprocessor 18. The roving head 24—translated by translation means 26—fills in appropriate spaces in the material substrate 12, these spaces being left by an electronically actuated needle head 28, said needle head 28 also being under the control of microprocessor 18.

Figure 3:
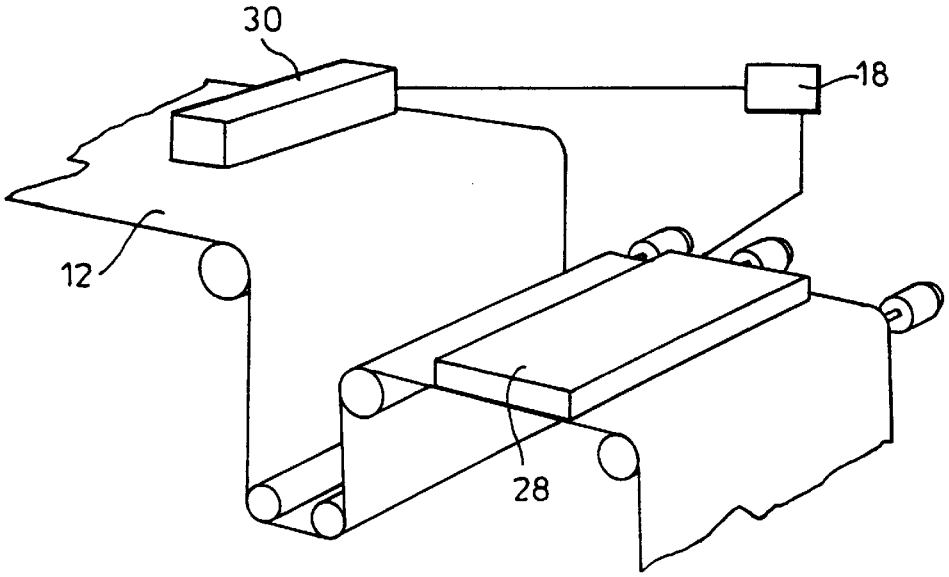
FIG. 3 shows a repair head arrangement.

The electronic actuators have position monitoring means and provide feedback data on instantaneous actuator force profiles to the microprocessor 18. One consequence of such data is that the failure of the needle to form a loop may be logged, and the system may decide whether to abort the tufting process or to correct the faults directly after the primary loop formation process. FIG. 3 depicts an embodiment in which the latter option may be achieved by provision of a repair head 30 having an electronically actuated needle or needles and operating under the control of microprocessor 18. The repair head 30 is translated laterally with respect to the motion of the material substrate 12, and is positioned in proximity to electronically actuated needle head 28, said needle head 28 providing the primary loop formation. This configuration may also be used to correct faulty tufting operations, by employing the repair head 30 to effect simultaneous inspection and loop mending. The Collet type head selects needles pre-threaded with yarns from a bank or carousel of such needles.

The present invention permits control of yarn tension via a feedback system. Since tufting yarn is a composite body of staple fibers, or synthetic filament material, or a combination of both, tension is an important factor in successful yarn loop formation. Heavily tensioned yarns will relax to their original length upon removal of tension loading. Since the energy required to form a loop is related to the yarn tension, information on yarn tension may be gathered via feedback from the actuators. Furthermore, such information may be augmented by monitoring of the pay-off of yarn from the creel input. The system can respond to the tension feedback information by either controlling needle velocity during the loop forming process or controlling pull-off rate from the yarn package, thereby ensuring that the applied yarn is under the correct tension. Although the embodiment described above employs actuator driven loopers and cutters operating under the control of the microprocessor, independently driven, mechanical loopers and cutters may also be employed.

2. Needling

Figure 4:
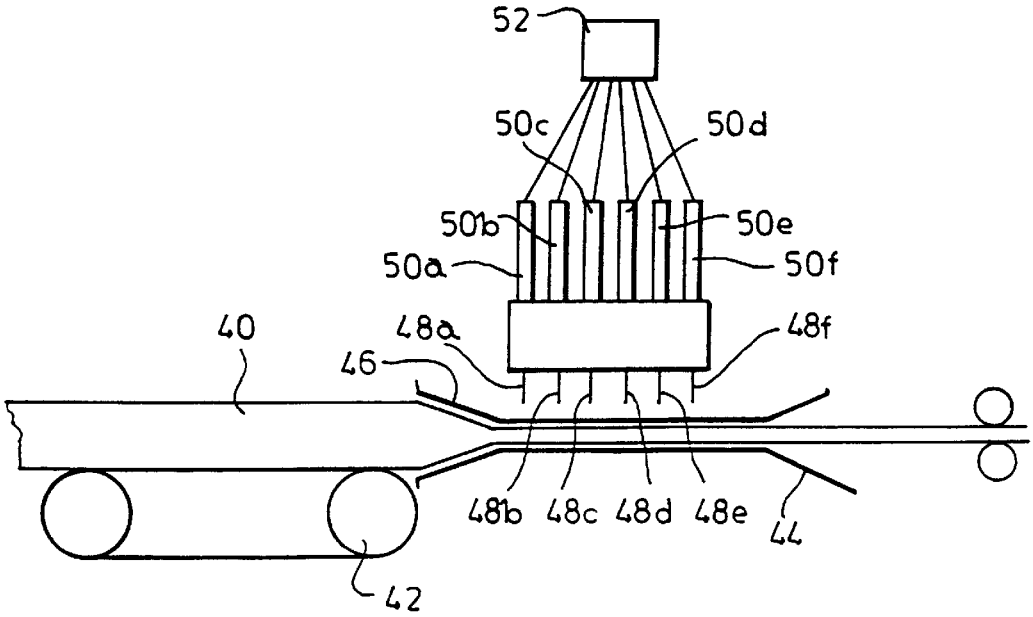
FIG. 4 shows a side view of a first needle loom.

FIGS. 4–6 and 9 depict various embodiments of needling machines which are in accordance with the present invention. FIG. 4 shows batting 40 which is translated, in the conventional manner, on a feeder arrangement 42 towards a bed plate 44 and a stripper plate 46. The bed plate 44 and stripper plate 46 have a plurality of perforations which permit the reciprocation of a plurality of barbed needles therethrough. In FIG. 4 a plurality of barbed needles 48*a*, 48*b*, 48*c*, 48*d*, 48*e*, 48*f* are reciprocated via the action of individual electrically controlled linear actuators 50*a*, 50*b*, 50*c*, 50*d*, 50*e*, 50*f* under the control of a microprocessor 52. Such an arrangement may be employed in instances where fabric edges require patterning or increased fiber compaction in order to increase edge strength, or parallel formats for borders, stripes or similar patterning requirements.

Figure 5:
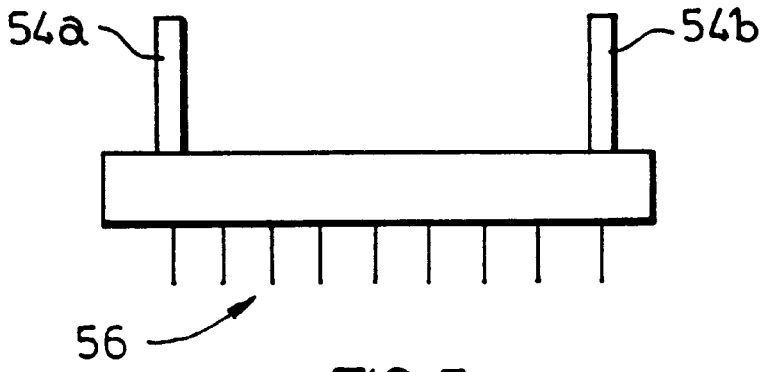
FIG. 5 shows a needle board arrangement.
Figure 6:
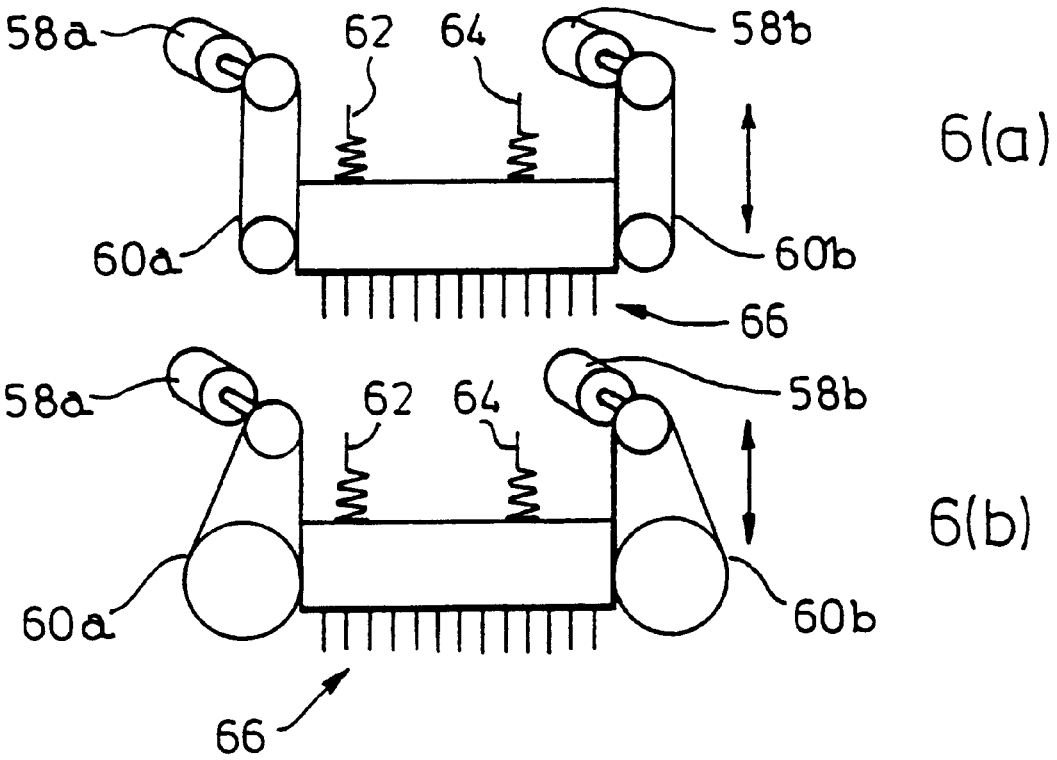
FIG. 6 shows various rotary actuator arrangements.

FIG. 5 shows a needle board arrangement wherein two linear actuators 54*a*, 54*b*, drive a plurality of barbed needles 56. It is possible to use a single actuator for this purpose, and it is also possible to employ springs to facilitate reciprocation. Furthermore the needle configuration may be a top punch one (as shown), bottom punch, or tandem. A full width needle board may be subdivided into a series of mini-needle boards, working from a plurality of actuators driving them as a single unit or individually. FIGS. 6*a* and 6*b* illustrates the use of rotary actuators 58*a*, 58*b* to drive, via pulley systems 60*a*, 60*b*, and with the assistance of springs 62, 64 a needle board having a plurality of needles 66. FIG. 6*a* depicts a "one to one" pulley system whereas FIG. 6*b* shows a power reduction arrangement. A further possibility is to merely employ suitable cables to convert rotary motion of the actuators 58*a*, 58*b* into linear motion of the needle board. In all instances the reciprocation of the needles is under the control of microprocessor 52. It is also possible to produce arcuate reciprocation of the needles using a rotary actuator and a suitable converter arrangement.

The feeder arrangement 42 may comprise further actuators which may be operated under the control of the microprocessor 52 or by a master-slave drive system or by a combination thereof, for continuous or synchronized movements.

The use of feedback data from the actuators permits real time monitoring of the needling process, since the energy required to produce compaction and/or penetration of the batting fabric provides information on fabric density. As a result, stroke and needle penetration characteristics can be monitored and adjusted to suit the required fabric performance parameters, e.g. needled fabric tension, fabric thickness, fabric density, and hole concentrations. Additionally, the microprocessor can operate in an "intelligent" or "teach mode" capacity in which the microprocessor "learns" about the process variables so that the ideal needling conditions can be reproduced.

Figure 9:
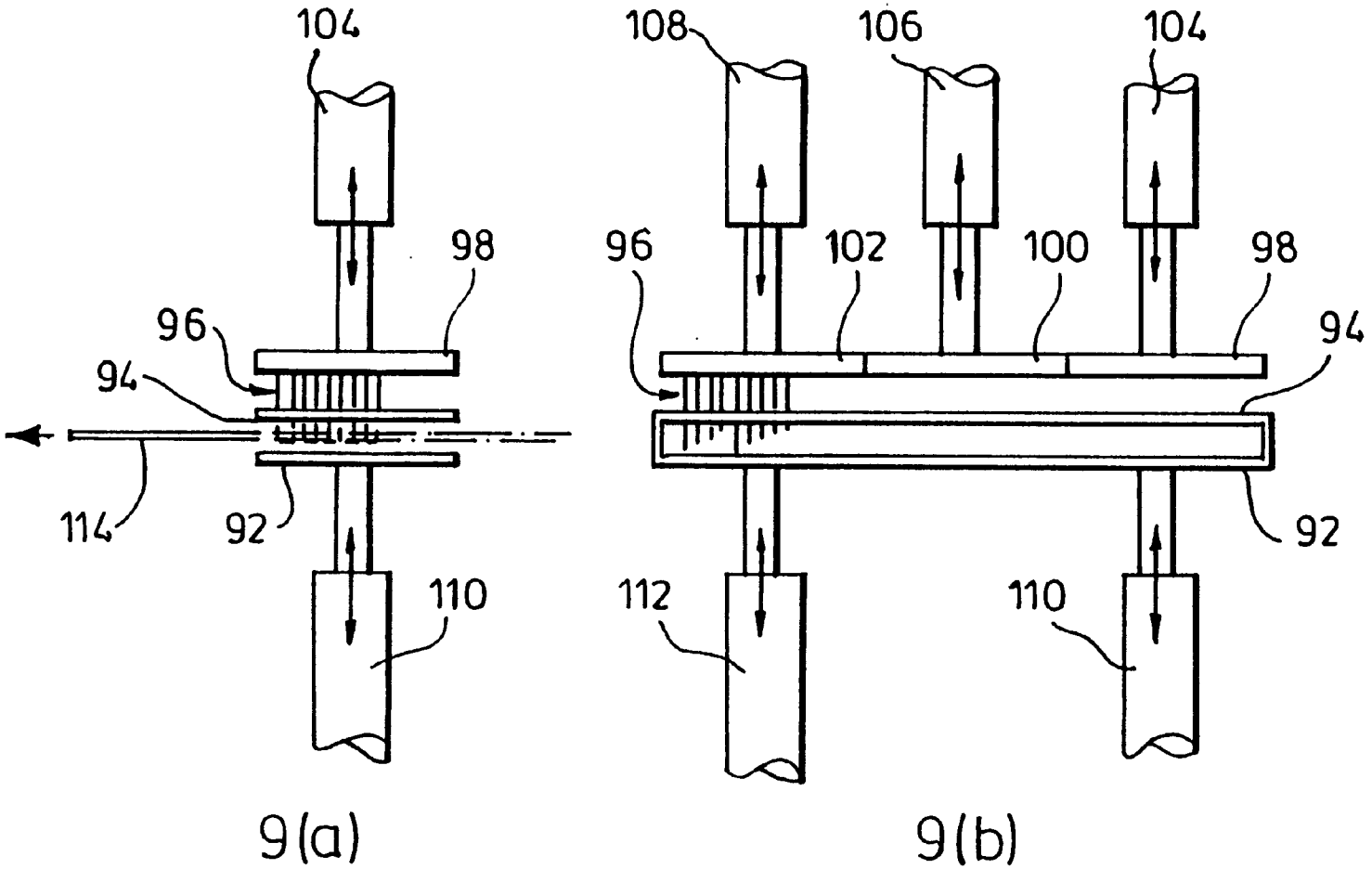
FIG. 9 shows a) a side view and b) a front view of portions of a second needle loom.

FIG. 9 shows views of portions of a needling machine according to the present invention comprising a bed plate 92 and a stripper plate 94 which have a plurality of perforations which permit reciprocation of a plurality of barbed needles 96 therethrough. The needles 96 are attached to a plurality of needle boards 98, 100, 102 which are driven by a plurality of linear actuators 104, 106, 108 acting under the control of a microprocessor (not shown). The bed plate 92 is also driven by linear actuators 110, 112 attached thereto which operate under the control of the microprocessor. Batting 114 is passed through the needle loom by means of rollers (not shown).

The linear actuators 110, 112 attached to the bed plate 92 act to translate the bed plate 92 and stripper plate 94 upward, this motion being in tandem with the downward motion of the needles 96. In this manner, the relative velocity of the needles 96 and the bed plate 92/stripper plate 94 is increased. This approach provides a number of benefits. Firstly, faster horizontal line speeds of the batting 114 may be employed. The practical upper limit of the line speed is determined by the amount of damage sustained by the batting 114 and/or the needles 96: this is caused by the lateral dragging of the batting 114 by the rollers (not shown) against the resistance of the withdrawing needles 96. By increasing the relative velocity of the needles 96 and the bed plate 92/stripper plate 94 the contact time between the needles 96 and the batting 114 is reduced, thereby reducing the extent of this damage at a given line speed. Secondly, the downward motion of the bed plate 92/stripper plate 94 assists in pulling the batting 114 from the retracting needles 96. Microprocessor control of the operation enables the optimum velocities to be selected. It should be noted that the needle boards and bed plate may be driven by the actuators so as to produce arcuate movement, instead of purely linear movement.

3. Sewing

Figure 7:
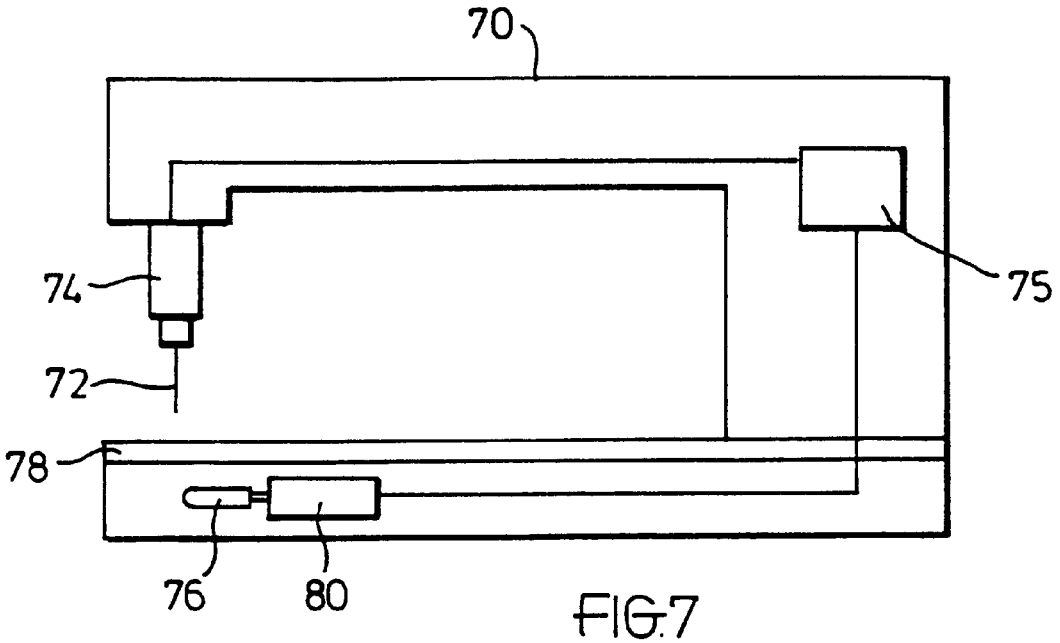
FIG. 7 shows a cross sectional side view of a sewing machine.

FIG. 7 shows a sewing machine 70 having a needle 72 mounted on an electronically controlled linear actuator 74 (Top Thread) which operates under the control of a microprocessor 75. Stitch locking means 76 (Bottom Thread) are located beneath a base plate 78; in this example the locking means comprise a bobbin containing shuttle, and said locking means are driven by a second linear actuator 80 which is also under the control of microprocessor 75. However, other stitch locking means are within the scope of the invention, for instance a gripper hook (requiring a rotary actuator). It is also possible to employ a plurality of sewing needles. The use of a master-slave system to drive the stitch locking means is also within the scope of the invention.

Figure 8:
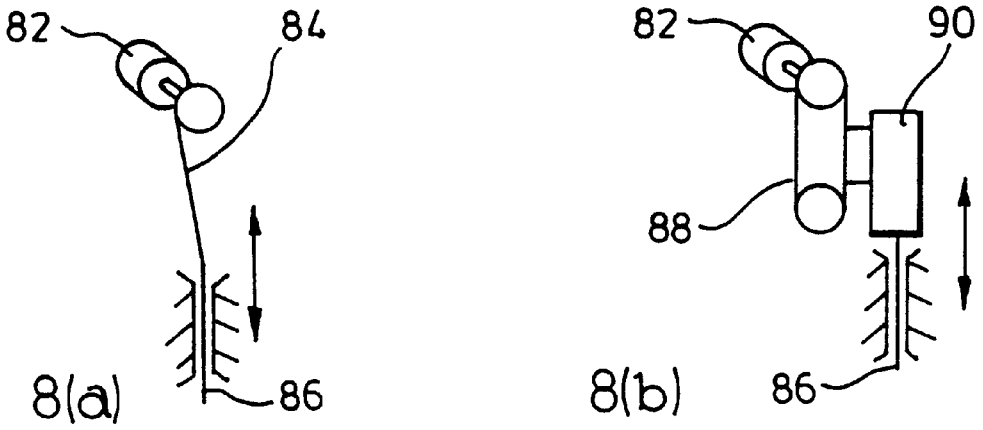
FIG. 8 shows alternative needle actuation arrangements.

FIG. 8 shows some alternative needle actuation systems, utilizing rotary actuators. In FIG. 8*a* rotary actuator 82 drives a cable 84 connected to a needle 86 thereby allowing reciprocation of said needle 86. In FIG. 8*b* the rotary actuator 82 drives a pulley system 88, said pulley system 88 being connected to a needle head 90 which in turn is connected to the needle 86. Combinations of linear and rotary actuators are, of course, also within the scope of the invention.

The loop forming motions of sewing machines of the present invention are performed under the direct control of the microprocessor, and thus the height and spacing of the yarn loops can be varied or maintained at a desired value by direct instruction from said microprocessor, on a stitch by stitch basis.

The stitch strokes and the spacings thereof are programmable permitting control of stitch patterns and sewing densities. Feedback data from the electronic actuators enables optimization of production and power requirement conditions, in a similar manner to that previously described. For example, changes in fabric density or sewing yarn quality cause variations in stitch formation which can be detected from the output of the actuators; the microprocessor can compensate rapidly for these changes. If necessary, the feedback control can vary needle penetration characteristics within the course of a single penetration action; for example the penetration force may be increased, or the penetration action may be aborted. A more specific example is provided by the control of yarn tension in situations where the thickness or density of the material in contact with the needle varies. In these situations, feedback from the actuation stroke is monitored, and the loop stroke is varied so as to maintain loop tension. Such tension control is important in the sewing of thick fabrics or leather materials since it substantially prevents puckering.

4. Fabrication of Three Dimensional Felted Structures

Figure 10:
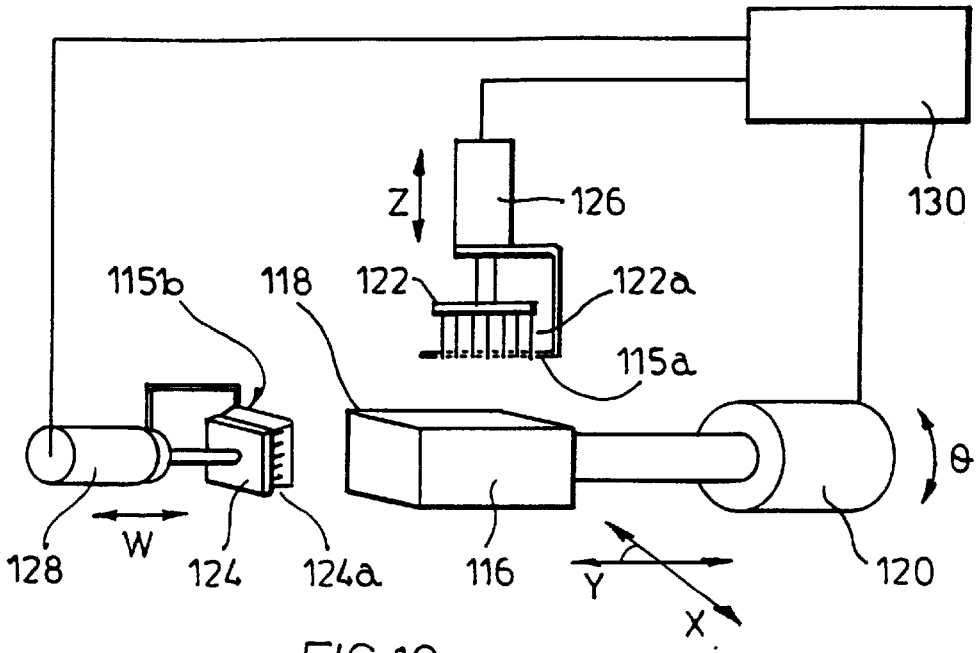
FIG. 10 is a schematic diagram of apparatus for producing a three dimensional felted structure.

FIG. 10 shows apparatus for fabricating a three dimensional felted structure from a rotatably mounted three dimensional non-woven material substrate body 116. The body is clamped by clamps 118 and rotated by a rotary actuator 120. The apparatus further comprises two needle boards 122 and 124, each board having a plurality of barbed needles 122*a* and 124*a* which are reciprocated into and out of the body 116 under the action of electrically controlled linear actuators 126 and 128. The actions of the rotary actuator 120 and the linear actuators 126 and 128 are controlled by a micro processor 130. Each needle board 122, 124 operates through a composite stripper plate 115*a*, 115*b* attached to the body of the corresponding actuator 126, 128 or the actuator mounting brackets.

By rotating the substrate body 116 during needling, five of the six sides of the body may undergo needling. Appropriate control of this rotation, together with control of the needling operations permit the production of a solid felted structure of defined three dimensional appearance. The needle board penetration actions are controlled by the micro processor 130 by which the needle penetration characteristics can be varied within the penetration action and or between penetration actions. In this manner, variation of needle penetration characteristics, such as stroke and stroke frequency, may be performed on a stroke-by-stroke basis, or even during a stroke, enabling rapid and flexible system adaption to variations in conditions in order to if maintain optimal operating efficiency.

As an alternative to rotation of the body 116, it is possible to use continuous path or point to point movement to perform three dimensional profiling and contouring. In these embodiments, relative movement of body and needling board(s) in two dimensions is provided, with the third dimension being defined by varying the stroke of the needle board(s).

It should be noted that, for the present purposes, the term "three dimensional" should be taken to mean structures whose thickness or height is of similar magnitude to the width thereof. In a stricter sense, all structures are, of course, three dimensional and, in particular, the structures described herein should not be confused with products commonly referred to as three dimensional fabrics, these being very thick fabrics whose thickness nevertheless is small compared to the width thereof—such a fabric may be, for example, 10 mmn thick and 1000 mm wide.

Electronic actuators have position monitoring means and provide feedback data on instantaneous actuator force profiles to the micro processor 130. The use of such actuator feedback data permits real time monitoring of the needling process, since the energy required to produce compaction and/or penetration of the non-woven material body 116 provides information on fabric density (teach mode). As a result, stroke and needle penetration characteristics can be monitored and adjusted to suit required fabric performance parameters, e.g., needled fabric tension and density. The use of feedback data from the rotary actuator 120 and adjustment of body rotation as a result of received feedback data is also within the scope of the invention (intelligence, teach mode).

The micro processor control of the needling process, together with the computerized movement of the body 116, may be performed essentially according to a pre-programmed algorithm, with the feedback data being (optionally) employed for flexible and adaptive real time system optimization in order to increase efficiency. However, an "intelligent" control system, in which data from the actuators are used to assess the progress of the fabrication process, thereby permitting calculation of the needling and relative movements operations subsequently required, is within the scope of the invention.

As described above it may be desirable to linearly translate either the substrate body 116 or the needle boards 122 and 124 whilst retaining the capability to rotate said body 116. It is also possible to employ a plurality of mini needle boards in the place of a single, full width needle board.

The shaped, three dimensional, felted structure may be used as an inexpensive alternative to standard engineering materials, such as metals, plastics and glass. The resulting needled structure may be plasticized, coated or heated in order to achieve the desired final finish and structural density.

Figure 11:
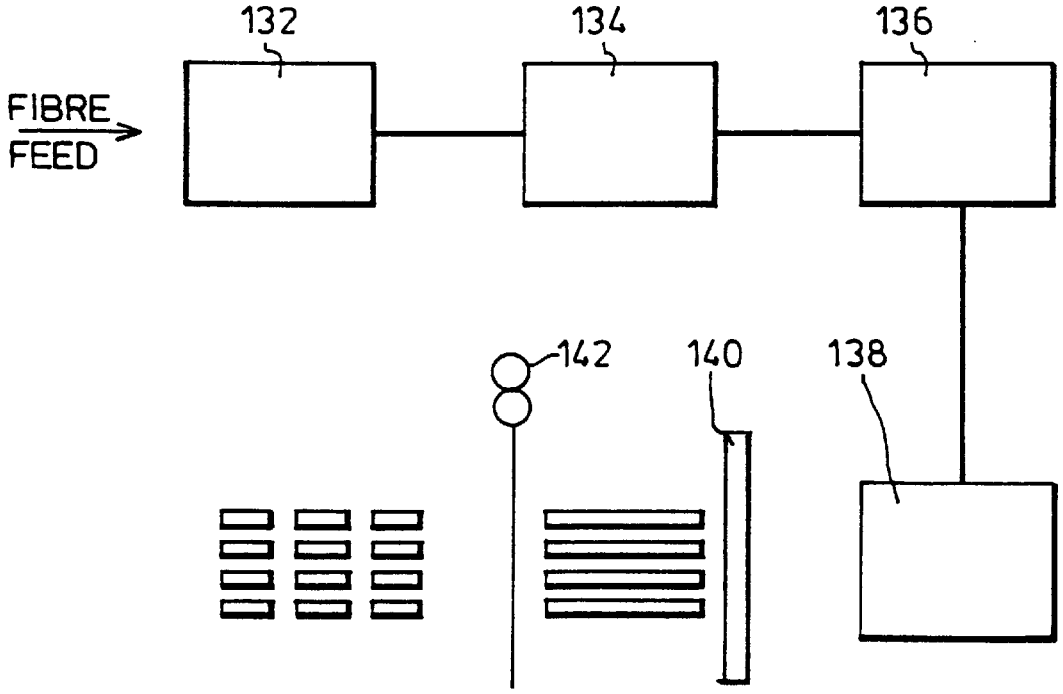
FIG. 11 is a schematic diagram of apparatus for substrate production.

Preferably, the non-woven material substrate body 116 is a "semi-solid", i.e. it is composed of fibers already lightly felted by a conventional needleloom process. FIG. 11 depicts a scheme for producing a suitable "semi-solid" body. A fibrous substrate is fed into an opening machine 132 and the resulting fiber is carded by a carding engine 134, folded in a lapper 136 and pre-needled in a needleloom 138. The latter process imparts some degree of discreet form to the felt. To produce the three dimensional substrate, the pre-needled felt is slit by a slitter 140 into strips and then cut in a perpendicular direction by a cross-cutter 142 to produce short length rectangular pieces which then may be mounted in the clamps 118. The clamping system itself can be modified to suit the final form and desired shape of the work piece and may be removed after a suitable period of needling action has created a sufficiently stable and solid or semi-solid object. The final process of needling those areas initially covered by the clamps can then be completed. Alternatively, the pieces may be joined molded, or rolled into shape.

Generally speaking, in traditional needle reciprocating machines the pitch length is pre-set and cannot be varied without stopping the process and resetting or reprogramming the new pitch lengths. Such is not the case with electronically controlled actuators employed in the present invention, since there exists a time window within each pitch period wherein the linear pitch is programmable. Needle stroke may be similarly varied, and this method of actuation provides for an infinite number of programming patterning formats.

In similar manner to the control of linear pitch, it is possible to control axial movement of the needles to produce variable cross pitches. In combination with linear pitch control flier patterning formats are possible, such as circles, scrolls, and diagonal and chevron formations. In the case of tufting with loop height control, three dimensional contour patterning is possible. A further advantage is that machine down-time between production changes is minimized, in fact, in some instances multitasking may be undertaken under the control of a single program, resulting in negligible down-time.

The system may operate without feedback control: in this instance the microprocessor determines the actuator performance ratings ("teach" mode). With feedback control, the feedback networks allow performance to rise or fall within specified limits whilst seeking to optimize system performance towards certain performance limits provided by the input data.

It is understood that whilst in the embodiments described above the control means has comprised a microprocessor, other forms of information processors, such as (microprocessor containing) computers are also within the scope of the invention.

Since electronically controlled actuators operate either directly or by low inertia, high efficiency means, mechanical friction is minimized and thus power requirements are minimized. Additionally, higher operating speeds than those achievable with conventional systems are possible due to the relatively low inertia of the mechanical systems employed and the high stiffness of the electronic controls.

Since each actuator has position monitoring means as a precaution against failure or malfunction, this feedback information may be utilized by the system to provide total maintenance, help-diagnostic and management data routines. For example, system or power failure stop sequences with diagnostic or re-set instructions may be provided.

Electronically controlled actuators may be operated flexibly, and thus, for example, during start up, stopping or during programmed changes in system operation feedback control can ensure that the ultimate fabric density is kept at a constant value.

The control means determines the function of the actuators and the rate at which said actuators perform their functions. The information is stored in memory, and can be entered at the keyboard or by a data inputting device. In teach mode, operators can configure product pattern and density; this information can be stored for immediate use or for use at some future stage. Production speed is also programmable. Pattern format data may be entered in CAD format via any suitable memory transfer means. The control means may advise and report on the management of the machines at desired frequencies. Furthermore, the control means can report on completed work and on instances of faults, together with fault diagnostics.

The control means can hold in memory the optimum operating conditions for each type of needle and/or material for any pattern format employed. The present invention may be applied to stand alone machines or fully integrated machines operating under the control of a host computer.

What is claimed is:

1. A method for tufting a fibrous substrate, comprising:

(a) penetrating the substrate with needle means comprising at least one yarn-inserting needle;

(b) reciprocating said needle means so that the substrate is penetrated by a plurality of penetrating actions of said needle means; and (c) controlling said needle means with control means including at least one electronically controlled servo actuator so as to permit variation by said control means of at least one characteristic of the penetrating action of said needle means between successive penetrating actions and during the course of a single penetrating action, wherein said at least one needle penetration characteristic comprises stitch or loop height, stroke, or pitch length.

2. The method according to claim 1, wherein said controlling comprises:

sensing at least one variable comprising actuator position, actuator force, or yarn tension; and adjusting said at least one needle penetration characteristic in response to said at least one variable.

3. The method according to claim 1 or 2, wherein said controlling is performed using a microprocessor or computer.

4. The method according to claim 3, wherein said servo actuator comprises a linear or rotary actuator.

5. The method according to claim 4, further comprising:

driving a looper into and out of engagement with yarn loops formed by said needle means; and controlling said looper driving with said actuator.

6. The method according to claim 5, further comprising controlling said looper driving with a master-slave system.

7. The method according to claim 4, further comprising:

cutting yarn loops formed by said needle means; and controlling said yarn loop cutting with said actuator.

8. The method according to claim 7, further comprising controlling said yarn loop cutting with a master-slave system.

9. A method for sewing a material substrate, comprising:

(a) penetrating the substrate with needle means comprising at least one yarn transporting needle;

(b) reciprocating said needle means so that the substrate is penetrated by a plurality of penetrating actions of said needle means; and (c) controlling said needle means with control means including at least one electronically controlled servo actuator so as to permit variation by said control means of at least one characteristic of the penetrating action of said needle means between successive penetrating actions and during the course of a single penetrating action, wherein said at least one needle penetration characteristic comprises stitch or loop height, stroke, stroke frequency, or pitch length.

10. The method according to claim 9, wherein said controlling comprises:

sensing at least one variable comprising actuator position, actuator force, or yarn tension; and adjusting said at least one needle penetration characteristic in response to said at least one variable.

11. The method according to claim 9 or 10, wherein said controlling is performed using a microprocessor or computer.

12. The method according to claim 11, wherein said servo actuator comprises a linear or rotary actuator.

13. The method according to claim 12, further comprising:

locking stitches formed by said needle means penetrating actions; and controlling said stitch locking with said actuator.

14. The method according to claim 13, further comprising controlling said stitch locking with a master-slave system.

15. An apparatus for tufting a fibrous substrate, comprising:

needle means comprising at least one yarn-inserting needle for penetrating the substrate, said needle means being reciprocable so that the substrate is penetrated by a plurality of penetrating actions of said needle means; and control means comprising at least one electronically controlled servo actuator for controlling said needle means so as to permit variation by said control means of at least one characteristic of the penetrating action of said needle means between successive penetrating actions and during the course of a single penetrating action, wherein said at least one needle penetration characteristic comprises stitch or loop height, stroke, or pitch length.

16. The apparatus according to claim 15, wherein said control means further comprises:

means for sensing at least one variable comprising actuator position, actuator force, or yarn tension; and means for adjusting said at least one needle penetration characteristic in response to said at least one variable.

17. The apparatus according to claim 16, wherein said sensing means comprises actuator position monitoring means, actuator force measurement means, or yarn tension monitoring means.

18. The apparatus according to claim 15 or 16, wherein said control means further comprises a microprocessor or computer.

19. The apparatus according to claim 18, wherein said servo actuator comprises a linear or rotary actuator.

20. The apparatus according to claim 19, further comprising a looper, said looper being drivable by said control means into and out of engagement with yarn loops formed by said needle means.

21. The apparatus according to claim 19, further comprising means for cutting yarn loops formed by said needle means, said cutting means being controlled by said control means.

22. An apparatus for sewing a material substrate, comprising:

needle means comprising at least one yarn-transporting needle for penetrating the substrate, said needle means being reciprocable so that the substrate is penetrated by a plurality of penetrating actions of said needle means; and control means comprising at least one electronically controlled servo actuator for controlling said needle means so as to permit variation by said control means of at least one characteristic of the penetrating action of said needle means between successive penetrating actions and during the course of a single penetrating action, wherein said at least one needle penetration characteristic comprises stroke or stroke frequency.

23. The apparatus according to claim 22, wherein said control means further comprises:

means for sensing at least one variable comprising actuator position, actuator force, or yarn tension; and means for adjusting said at least one needle penetration characteristic in response to said at least one variable.

24. The apparatus according to claim 23, wherein said sensing means comprises actuator position monitoring means, actuator force measurement means, or yarn tension monitoring means.

25. The apparatus according to claim 22 or 23, wherein said control means further comprises a microprocessor or computer.

26. The apparatus according to claim 25, wherein said servo actuator comprises a linear or rotary actuator.

27. The method according to claim 26, further comprising means for locking stitches formed by said needle means penetrating actions, said stitch locking being controlled by said control means.

* * * * *